US007156376B2

(12) United States Patent
Bungo et al.

(10) Patent No.: US 7,156,376 B2
(45) Date of Patent: Jan. 2, 2007

(54) CARBURETOR ELECTRONIC CONTROL SYSTEM

(75) Inventors: Keiichiro Bungo, Saitama (JP); Yoshinori Maekawa, Saitama (JP); Hayato Matsuda, Saitama (JP); Soji Kashima, Saitama (JP)

(73) Assignee: Honda Motor Co. Ltd., Tokyo (JP)

( * ) Notice: Subject to any disclaimer, the term of this patent is extended or adjusted under 35 U.S.C. 154(b) by 0 days.

(21) Appl. No.: 11/205,327

(22) Filed: Aug. 17, 2005

(65) Prior Publication Data

US 2006/0038305 A1 Feb. 23, 2006

(30) Foreign Application Priority Data

Aug. 18, 2004 (JP) ..... 2004-238743
Aug. 18, 2004 (JP) ..... 2004-238744
Aug. 18, 2004 (JP) ..... 2004-238745
Aug. 18, 2004 (JP) ..... 2004-238747

(51) Int. Cl.
*F02M 1/08* (2006.01)
*F02M 17/40* (2006.01)

(52) U.S. Cl. ..... 261/64.1; 261/64.4; 261/DIG. 74

(58) Field of Classification Search ..... 261/64.1–64.6, 261/DIG. 74; 123/399, 339.14
See application file for complete search history.

(56) References Cited

U.S. PATENT DOCUMENTS 4,120,274 A * 10/1978 De Lancey ..... 123/452
4,361,060 A * 11/1982 Smyth ..... 477/78
4,433,662 A * 2/1984 Muller et al. ..... 123/438
4,500,478 A * 2/1985 Furukawa et al. ..... 261/52
4,515,040 A * 5/1985 Takeuchi et al. ..... 477/43
4,524,742 A * 6/1985 Bonfiglioli et al. ..... 123/438
4,693,220 A * 9/1987 Hasebe et al. ..... 123/339.28
4,753,202 A * 6/1988 Hasebe et al. ..... 123/339.28
5,025,757 A * 6/1991 Larsen ..... 123/48 R
5,027,769 A * 7/1991 Yoshida et al. ..... 123/399
5,660,765 A * 8/1997 King et al. ..... 261/39.3
6,039,027 A 3/2000 Sato et al. ..... 123/399
6,880,812 B1 * 4/2005 Nonaka ..... 261/26
2002/0029760 A1 3/2002 Saito et al. ..... 123/396
2003/0136930 A1 7/2003 Dowden et al. ..... 251/129.11
2003/0196638 A1 10/2003 Matsuda et al. ..... 123/342
2005/0194700 A1 * 9/2005 Moriyama et al. ..... 261/39.4

FOREIGN PATENT DOCUMENTS

DE 29 50 866 A1 6/1981
JP 56-150834 11/1981
JP 4-1455 * 1/1992

* cited by examiner

*Primary Examiner*—Richard L. Chiesa
(74) *Attorney, Agent, or Firm*—Arent Fox PLLC

(57) ABSTRACT

A carburetor electronic control system includes: transmission devices coupled to valves for opening and closing an intake path of a carburetor; electric motors that make the valves open and close via the transmission devices; and an electronic control unit for controlling the operation of the electric motors. The interior of a casing joined to one side face of the carburetor is divided by a partition plate into a transmission chamber on the carburetor side and a drive chamber on the opposite side. The transmission devices and the electric motors are housed and held in the transmission chamber and the drive chamber, respectively. Therefore, the transmission devices, the electric actuators, and the electronic control unit can be housed in a common casing, thereby reducing the dimensions of the carburetor electronic control system.

9 Claims, 14 Drawing Sheets

CHOKE VALVE FULLY CLOSED

CHOKE VALVE FULLY OPENED

CHOKE VALVE OPENED BY RELIEF MECHANISM

LEVER RATIO BETWEEN RELIEF LEVER AND CHOKE LEVER
(TORQUE ON CHOKE VALVE SHAFT)

CARBURETOR ELECTRONIC CONTROL SYSTEM

RELATED APPLICATION DATA

The Japanese priority application Nos. 2004-238743, 2004-238744, 2004-238745 and 2004-238747, all filed on Aug. 18, 2004, upon which the present application is based are hereby incorporated in their entirety herein by reference.

BACKGROUND OF THE INVENTION

1. Field of the Invention

The present invention relates to a carburetor electronic control system that is mainly applied to a general purpose engine, and particularly to an improvement in a carburetor electronic control system that includes a transmission device coupled to a valve such as a choke valve or a throttle valve for opening and closing an intake path of a carburetor, an electric actuator for making the valve open and close via the transmission device, and an electronic control unit for controlling the operation of the electric actuator.

2. The Related Art

Such a carburetor electronic control system is known from Japanese Utility Model Registration Application Laid-open No. 56-150834.

In the conventional carburetor electronic control system, since a transmission device and an electric actuator are mounted separately from an electronic control unit on a carburetor or an engine, it is necessary to employ individual casings in order to protect them from external disturbance, resulting in that the casings become a hindrance in downsizing particularly of general purpose engines, which are used by being coupled to various types of work machines.

SUMMARY OF THE INVENTION

The present invention has been accomplished under the above-mentioned circumstances, and it is an object thereof to provide a carburetor electronic control system that enables a transmission device, an electric actuator, and an electronic control unit to be housed in a common casing, thereby contributing to a reduction in the dimensions of the casing and consequently making compact the entire engine including a carburetor.

In order to achieve the above-mentioned object, according to a first feature of the invention, there is provided a carburetor electronic control system comprising: a transmission device coupled to a valve for opening and closing an intake path of a carburetor; an electric actuator that makes the valve open and close via the transmission device; and an electronic control unit for controlling the operation of the electric actuator, wherein the interior of a casing joined to one side face of the carburetor is divided by a partition plate into a transmission chamber on the carburetor side and a drive chamber on the side opposite thereto; and the transmission device and the electric actuator are housed and held in the transmission chamber and the drive chamber, respectively.

The above-mentioned valve corresponds to a choke valve 7 and a throttle valve 8 of an embodiment of the present invention, which will be described later, the electric actuator corresponds to first and second electric actuators 20 and 21 of the embodiment, and the transmission device corresponds to first and second transmission devices 24 and 25 of the embodiment.

With the first feature of the present invention, the transmission device, the electric actuator, and the electronic control unit can be housed in the common casing, thereby reducing the dimensions of the casing which is mounted on one side of the carburetor, and consequently making compact the entire engine including the carburetor. Moreover, since the transmission device and the electric actuator are housed and held in the transmission chamber and the drive chamber, respectively, which are defined within the casing by the partition plate, it is possible to avoid interference between the transmission device and a wire harness extending from the electric actuator, thereby preventing any damage to the wire harness.

According to a second feature of the present invention, in addition to the first feature, the valve is a choke valve; the transmission device coupled thereto comprises a pinion fixedly provided on an output shaft of the electric actuator, a large diameter gear meshing with the pinion, a first lever that pivots together with the large diameter gear, and a second lever that is fixedly provided on a valve shaft of the choke valve and is pivoted by the first lever; and a structure with which the first and second levers are coupled is arranged so that a lever ratio between the first lever and the second lever increases in shifting from a medium-opening degree position of the choke valve to a fully opened position.

With the second feature of the present invention, since the lever ratio between the first lever and the second lever in the transmission device increases in shifting from the medium-opening degree position of the choke valve to the fully opened position, when the electric actuator makes the choke valve close from the fully opened position, a sufficiently large torque can be applied to the choke valve. Therefore, even if the choke valve is in an iced state, the icing can be crushed when starting the engine, thus reliably closing the choke valve. Further, since it is unnecessary in the transmission device to employ a reduction gear apart from the pinion and the large diameter gear, it is possible to make the transmission device compact, consequently reduce the capacity of the transmission chamber, and contribute to making the casing compact. Furthermore, there is no need to give the pinion and the large diameter gear an excessive gear ratio, or concerns about degradation in the tooth base strength of the gears due to an excessive reduction in the module thereof.

According to a third feature of the present invention, in addition to the second feature, the structure with which the first and second levers are coupled comprises a connecting pin that is projectingly provided on a side face at an extremity of one of the first and second levers, and an oblong hole that is provided in the other one of the first and second levers and extends in the longitudinal direction thereof, the connecting pin slidably engaging with the oblong hole; and the lever ratio between the first lever and the second lever increases in shifting from the medium-opening degree position of the choke valve to the fully opened position by changing an effective arm length of the first lever or the second lever according to a change in the opening degree of the choke valve.

With the third feature of the present invention, it is possible to achieve variable lever ratio characteristics between the first lever and the second lever with an extremely simple structure.

According to a fourth feature of the present invention, in addition to the first feature, the valve is a choke valve; the transmission device coupled thereto and the electric actuator are housed within the casing mounted on one side face of the carburetor; and the transmission device is provided with a relief mechanism which allows the choke valve to be opened by intake negative pressure that is equal to or higher than a predetermined value and that is generated in the intake path, the relief mechanism being disposed between and offset from the top of an output shaft of the electric actuator and the top of a valve shaft of the choke valve.

With the fourth feature of the present invention, since the relief mechanism is positioned so as to be offset from the top of the output shaft of the electric actuator and the top of the valve shaft of the choke valve, the relief mechanism is not superimposed on the output shaft of the electric actuator or the valve shaft of the choke valve. Therefore, it is possible to make flat the casing for housing the transmission device and the electric actuator, so that the entire engine including the carburetor can be made compact.

According to a fifth feature of the present invention, in addition to the first feature, the casing comprises a casing main body that is joined to one side face of the carburetor, and a lid that blocks an open face of the casing main body; the transmission device and the electric actuator are held within the casing main body; and at least one part of the lid is formed from the electronic control unit.

With the fifth feature of the present invention, the transmission device and the electric actuator are held within the casing main body, and at least part of the lid is formed from the electronic control unit. Therefore, it is possible to house the transmission device, the electric actuator, and the electronic control unit in the common casing, thereby reducing the dimensions of the casing which is mounted on one side of the carburetor, and consequently enabling the entire engine including the carburetor to be made compact.

According to a sixth feature of the present invention, in addition to the fifth feature, the electronic control unit comprises a board that has wiring of an electronic control circuit printed thereon and is disposed so as to close the open face of the casing main body, and various types of electronic components that are mounted on a side of the board that faces the interior of the casing main body; and among the various types of electronic components, tall large electronic components and the electric actuator are disposed on one side and the other side respectively within the casing main body.

With the sixth feature of the present invention, since the electric actuator and the large electronic components are arranged in a staggered manner, they can be housed efficiently within the casing. Therefore, it is possible to greatly reduce dead space within the casing, thus contributing to making the casing compact.

According to a seventh feature of the present invention, in addition to the fifth or sixth feature, the lid comprises the electronic control unit and a cover that is fixed to the casing main body so as to hold the electronic control unit between the cover and the casing main body.

With the seventh feature of the present invention, the open face of the casing main body is blocked by the electronic control unit, and the electric control unit can be fixed reliably to the casing main body while protecting the electronic control unit with the cover.

According to an eighth feature of the present invention, in addition to the sixth feature, a soft synthetic resin coating is formed on surfaces of the board and the various types of electronic components so as to cover the surfaces, the coating being in intimate contact with the open end face of the casing main body.

With the eighth feature of the present invention, not only can the coating of the soft synthetic resin formed on the surfaces of the board and the various types of electronic components seal the board and the various types of electronic components, but also the lid and the casing main body can be sealed together. Therefore, it is unnecessary to employ a seal used exclusively for this purpose, thereby contributing to a reduction in the number of components. Furthermore, since the above-mentioned coating is formed with a uniform thickness along the surfaces of the board and the various types of electronic components, there are no wastefully thick parts which would otherwise interfere with the staggered arrangement of the electric actuator and the large electronic components, thus contributing to making the casing compact.

According to a ninth feature of the present invention, in addition to the fifth feature, a soft synthetic resin coating is formed on a surface of the electronic control unit so as to cover the surface, the coating being in intimate contact with the open end face of the casing main body.

With the ninth feature of the present invention, not only can the coating of the soft synthetic resin formed on the surface of the electronic control unit seal the electronic control unit, but also the lid and the casing main body can be sealed together. Moreover, the above-mentioned coating is formed with a uniform thickness along the surface of the electronic control unit. Therefore, there are no wastefully thick parts which would otherwise interfere with the staggered arrangement of the electric actuator and the large electronic components, thus contributing to making the casing compact.

The above-mentioned object, other objects, characteristics, and advantages of the present invention will become apparent from an explanation of a preferred embodiment that will be described in detail below by reference to the attached drawings.

DESCRIPTION OF THE PREFERRED EMBODIMENT

Figure 1:
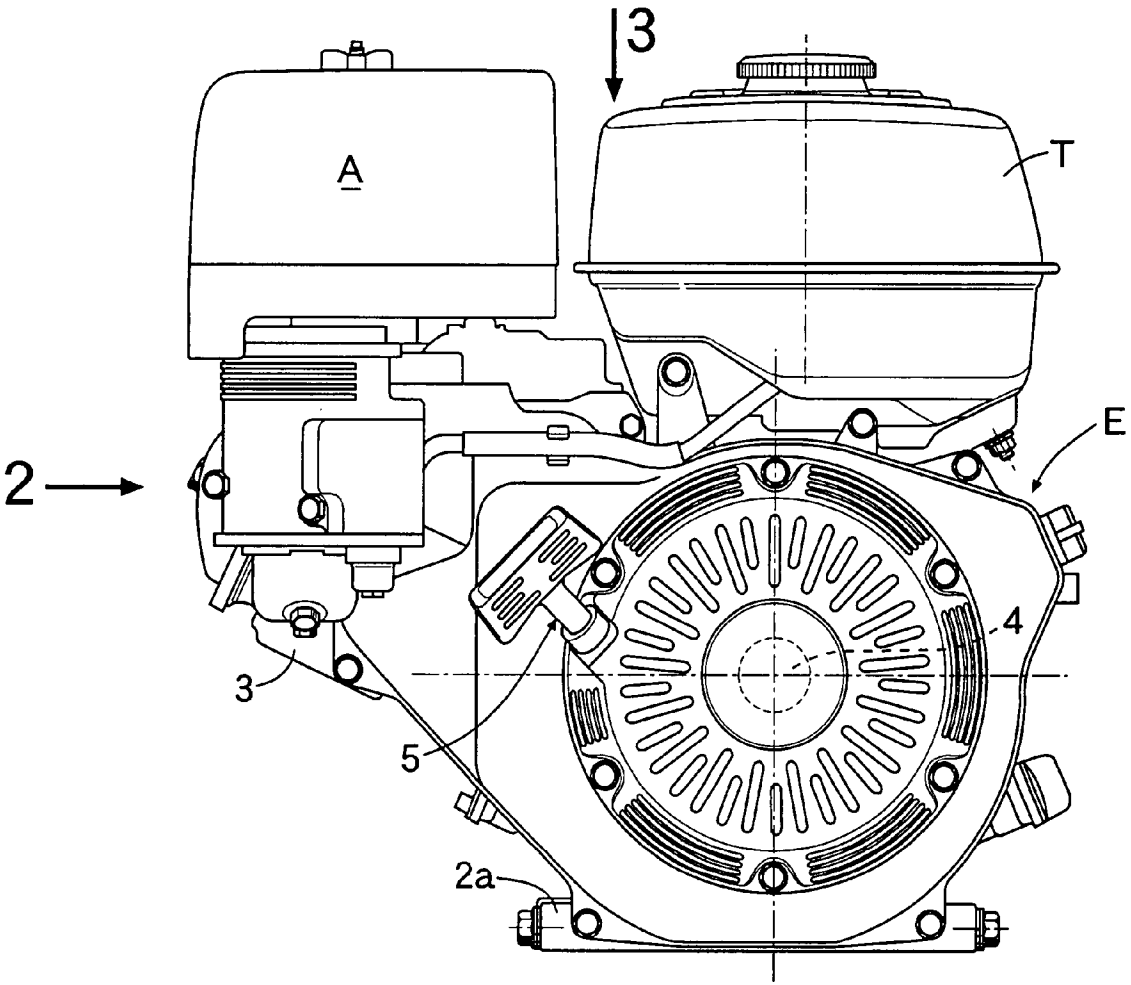
FIG. 1 is a front view of a general purpose engine according to an embodiment of the present invention.
Figure 2:
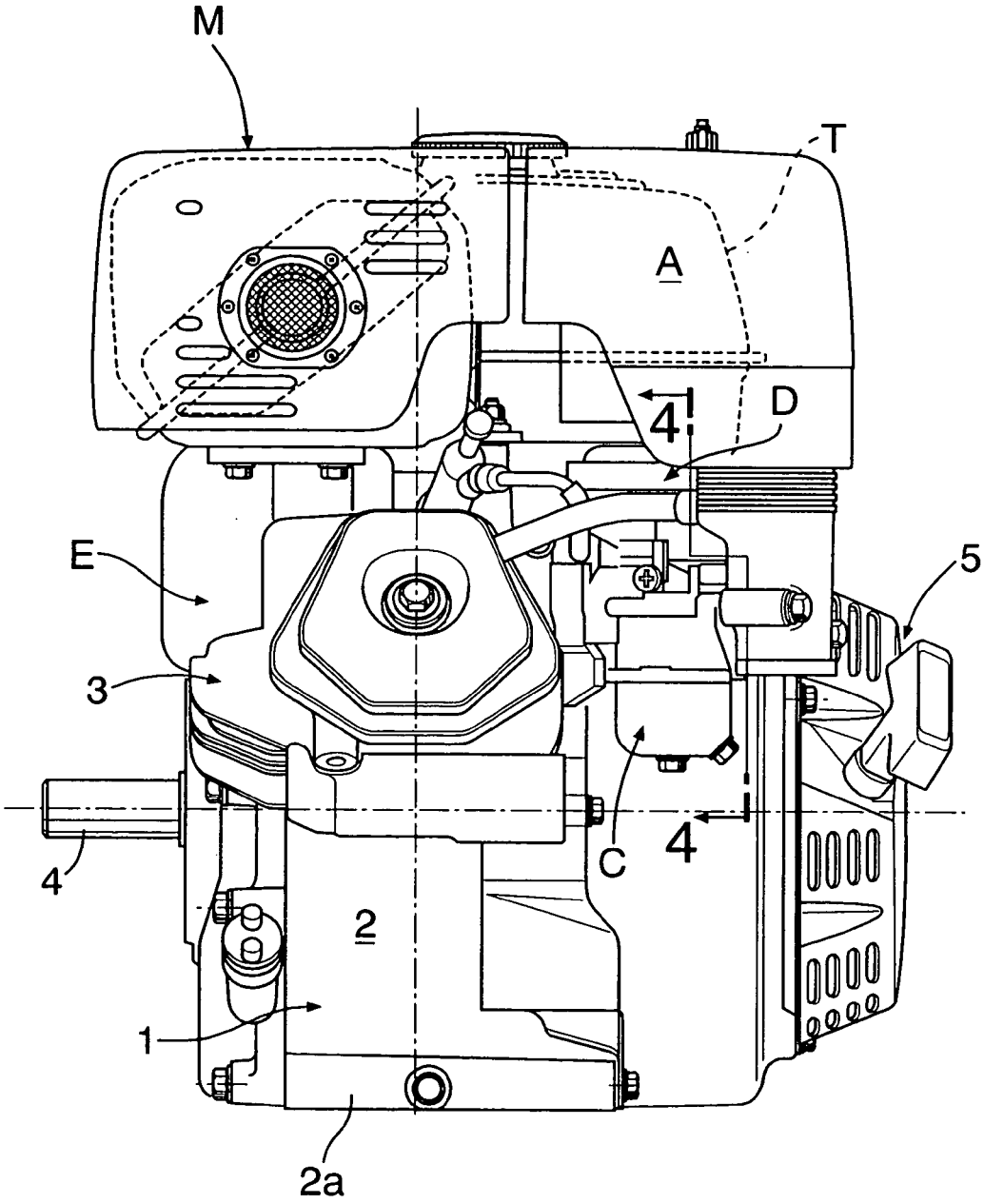
FIG. 2 is a view from arrow 2 in FIG. 1.
Figure 3:
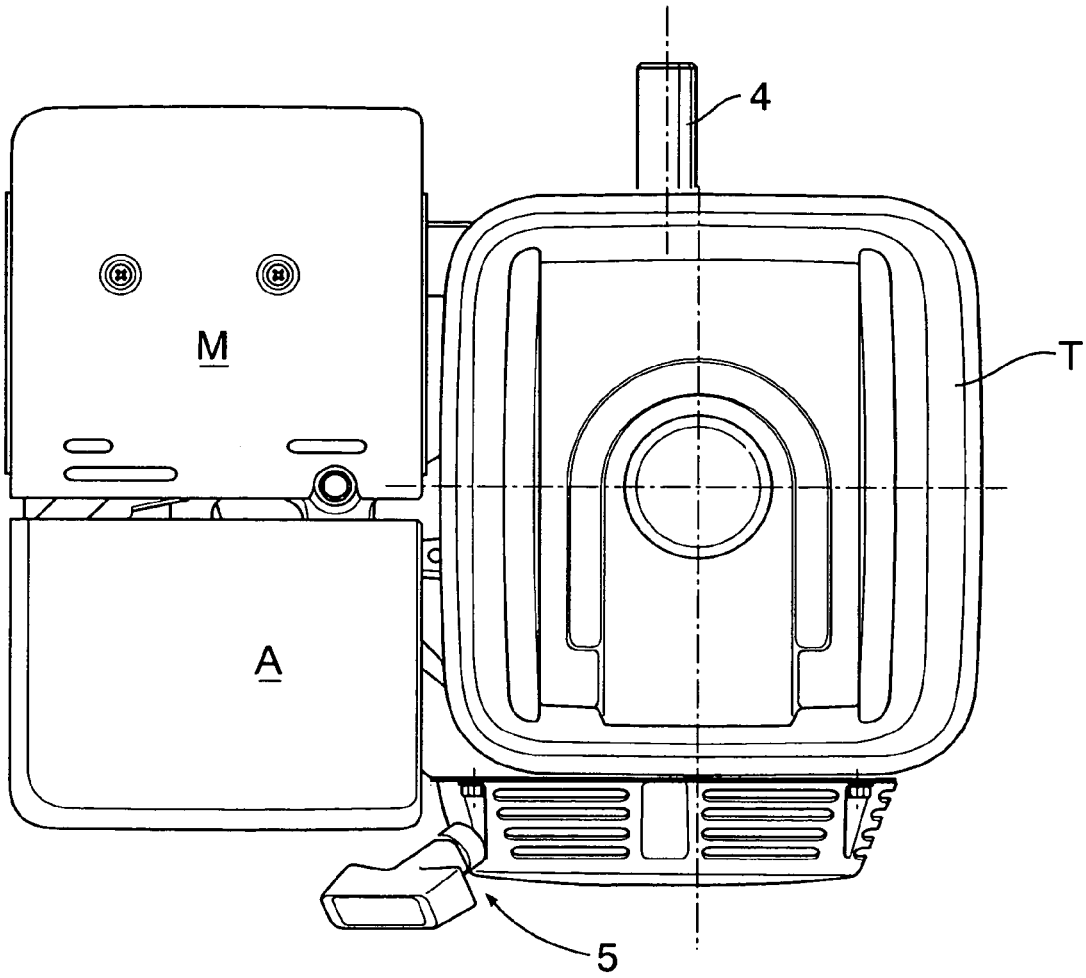
FIG. 3 is a view from arrow 3 in FIG. 1.

Firstly, as shown in FIG. 1 to FIG. 3, an engine main body 1 of a general purpose engine E includes: a crank case 2 having a mounting flange 2*a* on a lower face thereof and horizontally supporting a crank shaft 4; and a cylinder 3 projecting obliquely upward on one side from the crank case 2. A recoil type engine starter 5 for cranking the crank shaft 4 is mounted on a front side of the crank case 2. Mounted on the engine main body 1 are a fuel tank T disposed above the crank case 2, and an air cleaner A and an exhaust muffler M adjoining the fuel tank T above the cylinder 3. Attached to one side of a head part of the cylinder 3 is a carburetor C for supplying into the cylinder 3 an air-fuel mixture formed by taking in air through the air cleaner A.

Figure 4:
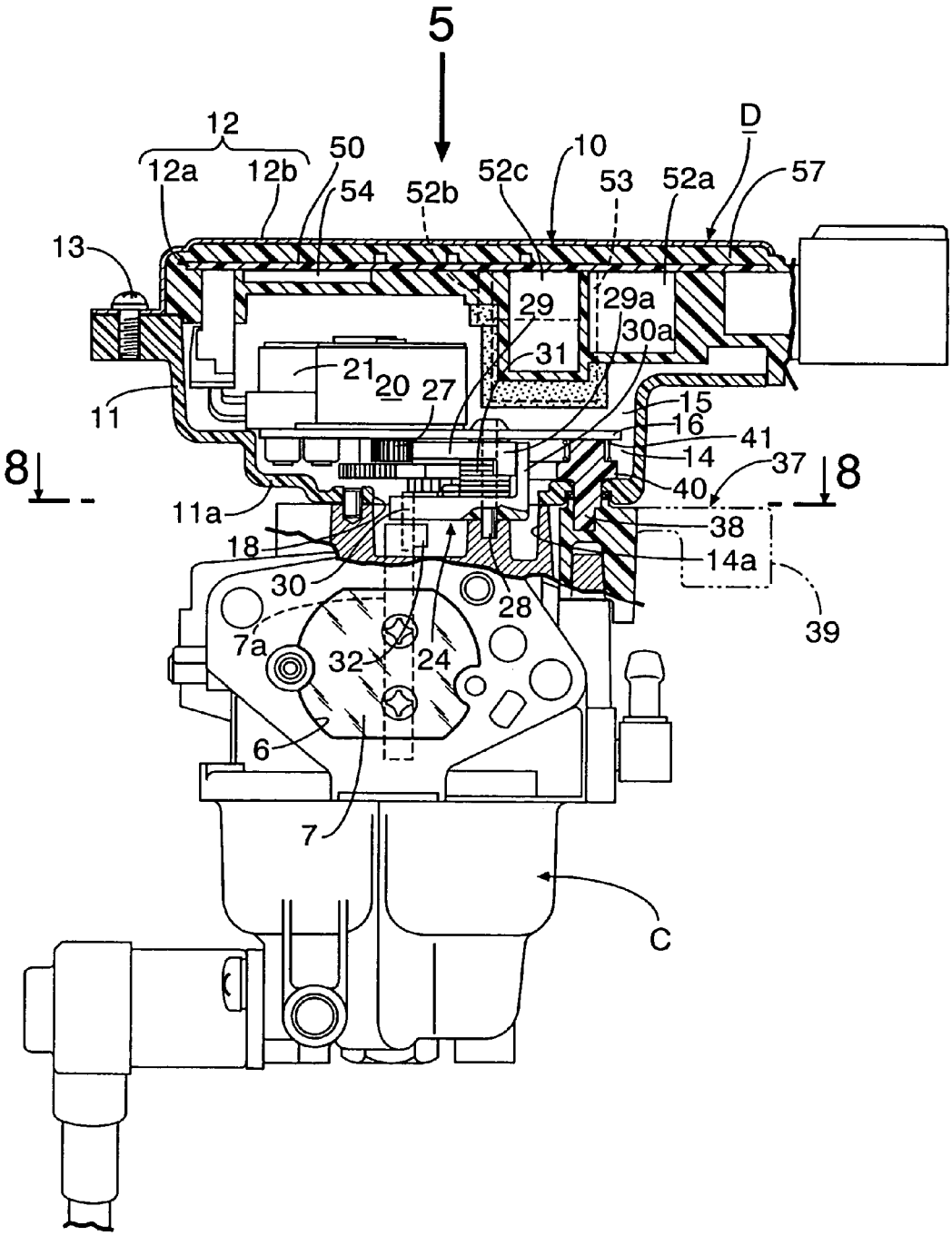
FIG. 4 is a sectional view along line 4—4 in FIG. 2.
Figure 8:
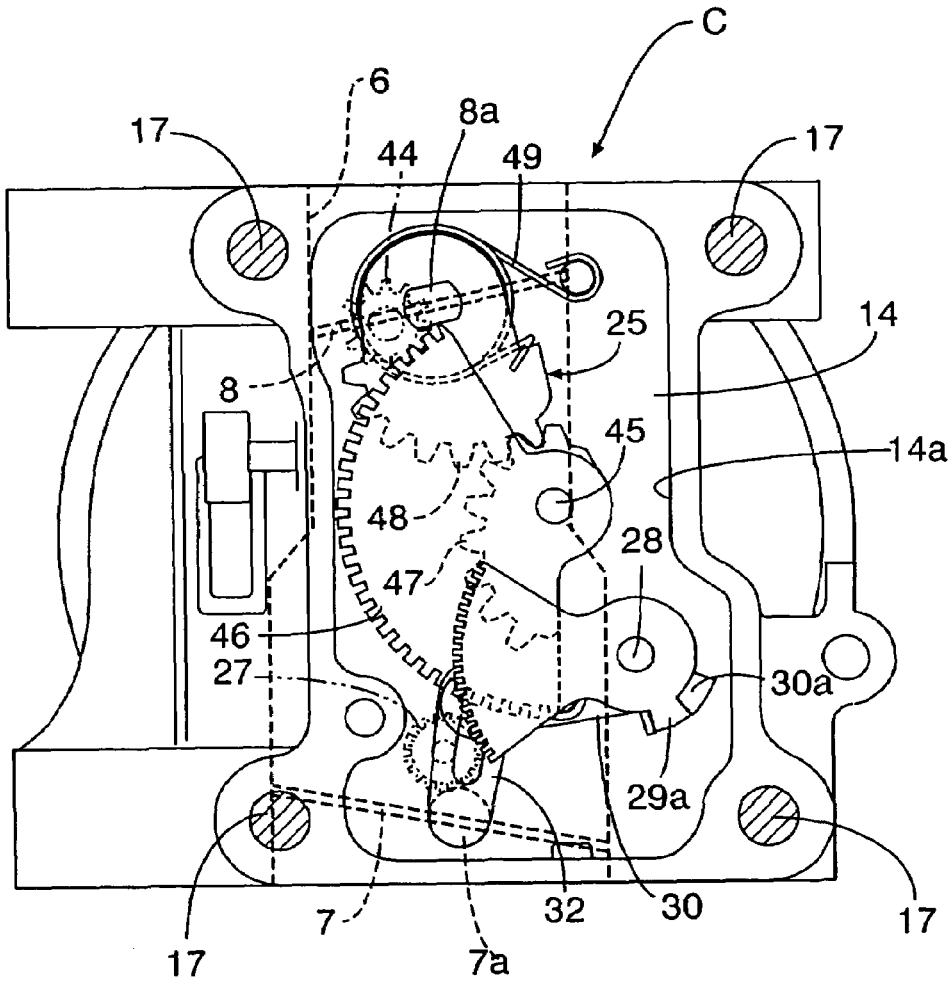
FIG. 8 is a sectional view along line 8—8 in FIG. 4.

As shown in FIG. 4 and FIG. 8, the carburetor C has an intake path 6 communicating with an intake port of the head part of the cylinder 3. In the intake path 6, sequentially from the upstream side, that is, from the air cleaner A side, a choke valve 7 and a throttle valve 8 are disposed. A fuel nozzle (not illustrated) opens in a venturi part of the intake path 6 in a middle section between the two valves 7 and 8. Both the choke valve 7 and the throttle valve 8 are of a butterfly type, in which they are opened and closed by pivoting of valve shafts 7*a* and 8*a*. An electronic control system D for automatically controlling the degree of opening of the choke valve 7 and the throttle valve 8 is mounted above the carburetor C. Hereinafter, the valve shaft 7*a* of the choke valve 7 is called a choke valve shaft 7*a*, and the valve shaft 8*a* of the throttle valve 8 is called a throttle valve shaft 8*a*.

The electronic control system D is explained by reference to FIG. 4 to FIG. 14.

Figure 5:
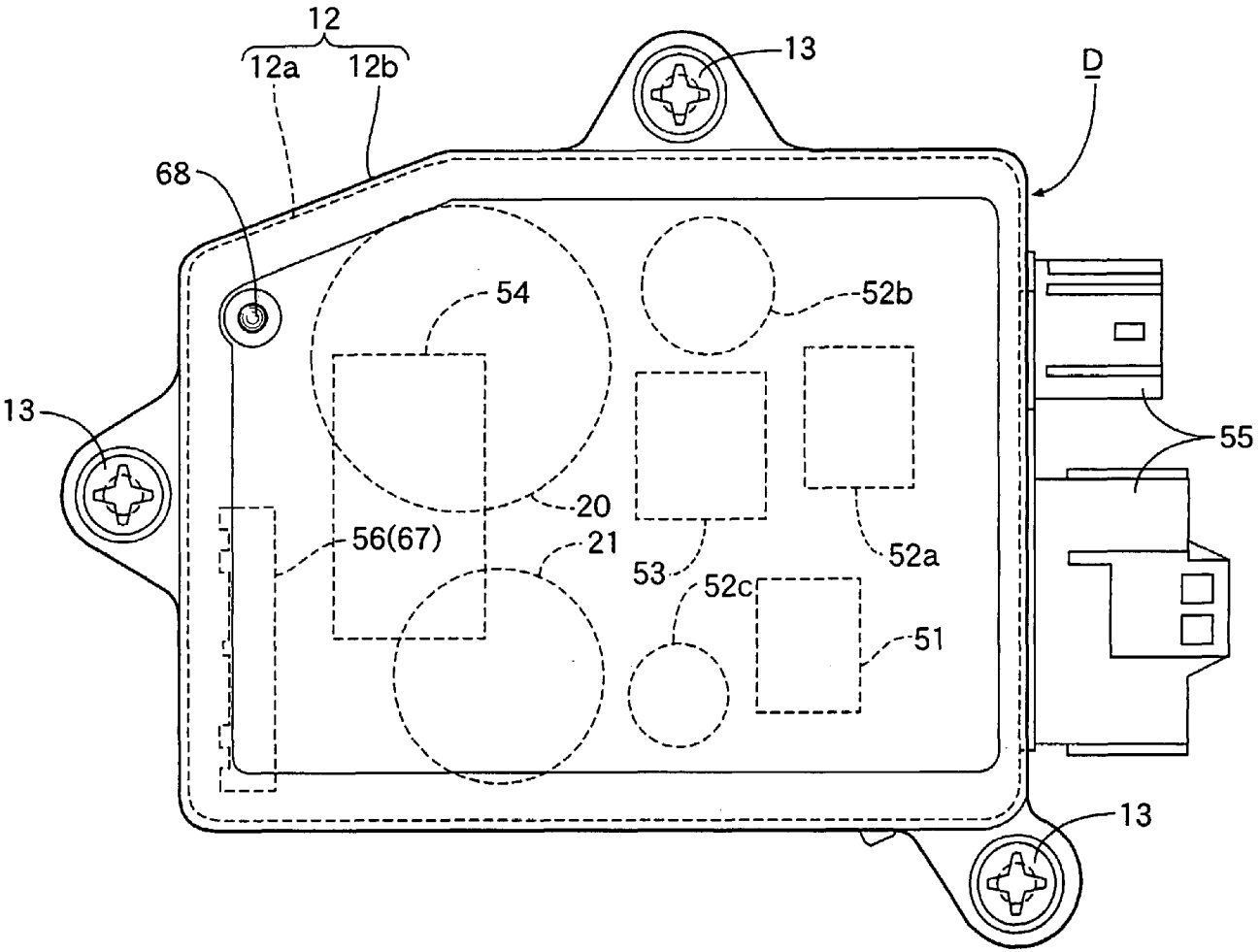
FIG. 5 is a view from arrow 5 in FIG. 4 (a plan view of an electronic control system).

Firstly, in FIG. 4 and FIG. 5, a casing 10 of the electronic control system D for the valves includes: a casing main body 11 having a base wall 11*a* joined to an upper end face of the carburetor C; and a lid 12 joined to the casing main body 11 so as to close an open face thereof. The lid 12 includes an electronic control unit 12*a* and a cover 12*b*. The electronic control unit 12*a* is disposed so as to be superimposed on the open end face of the casing main body 11. The cover 12*b* is made of sheet steel covering the electronic control unit 12*a* and joined to the casing main body 11 by bolts 13 so as to hold the electronic control unit 12*a* between the steel sheet cover 12*b* and the casing main body 11. The electronic control unit 12*a*, which closes the open face of the casing main body 11, is therefore fixed to the casing main body 11 while being protected by the cover 12*b*.

Figure 6:
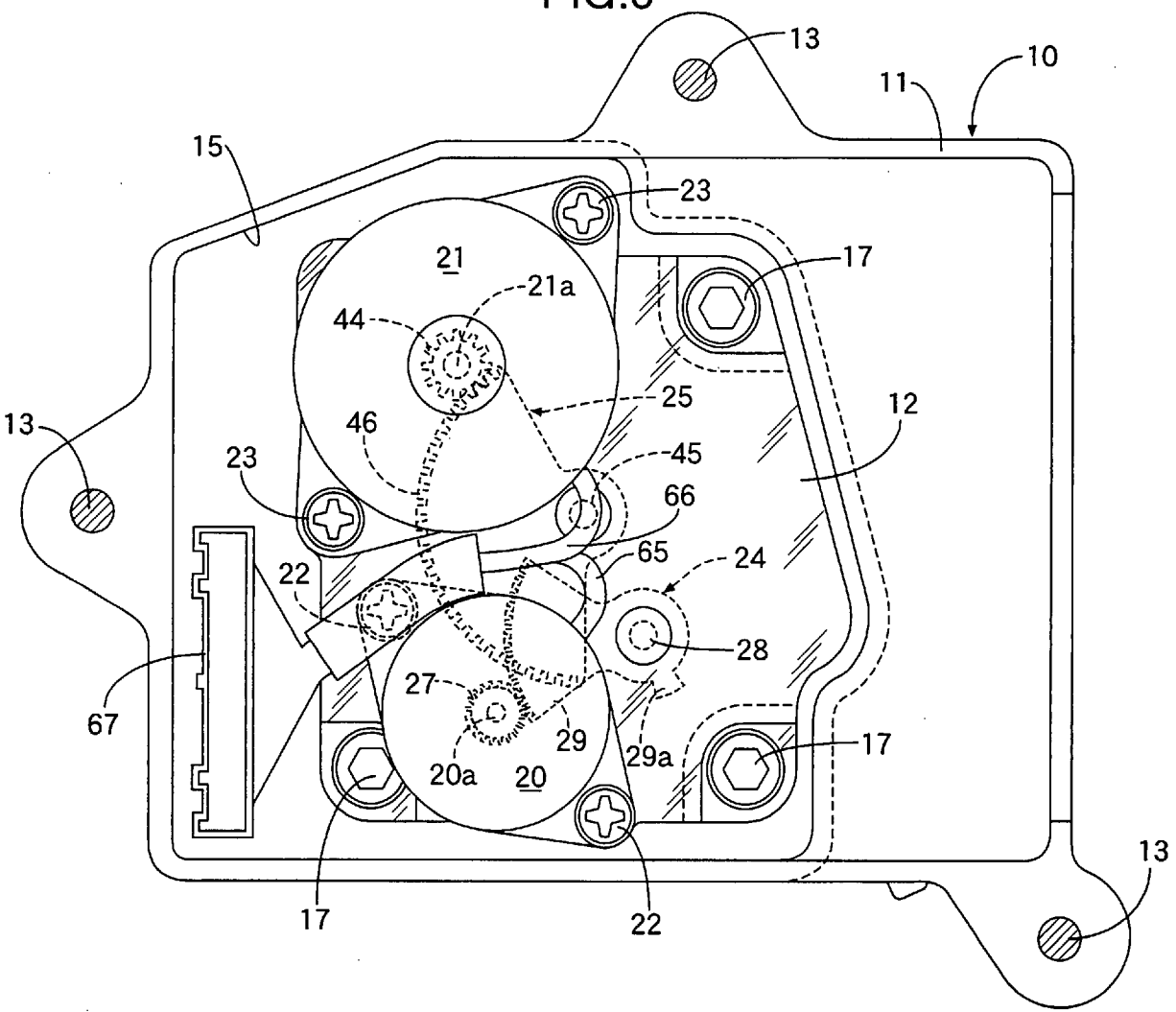
FIG. 6 is a plan view showing the electronic control system with its lid taken off.
Figure 7:
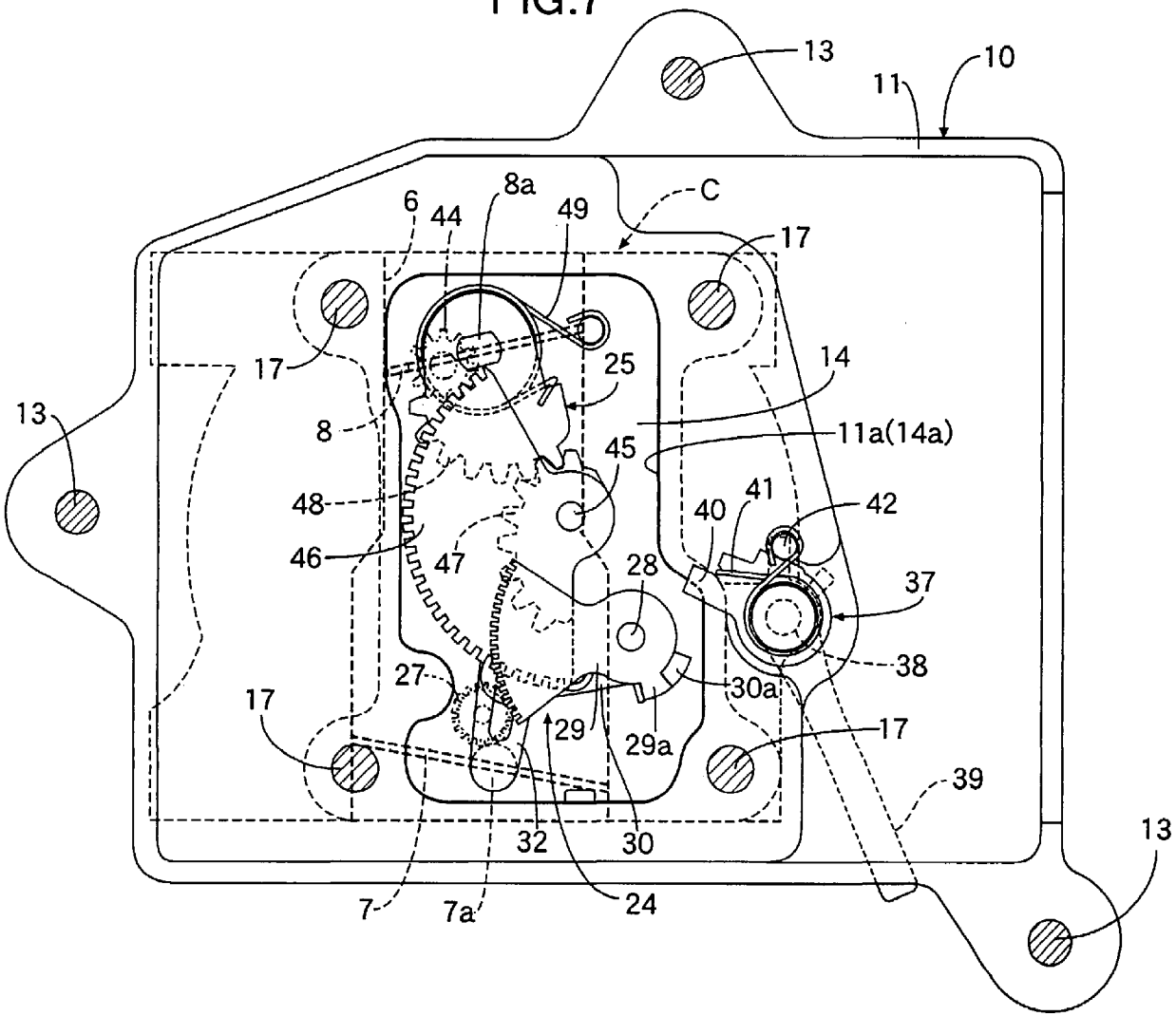
FIG. 7 is a plan view showing the electronic control system with its lid and partition taken off.

As shown in FIG. 4, FIG. 6, and FIG. 7, a partition plate 16 is provided within the casing main body 11 to divide the interior of the casing 10 into a transmission chamber 14 on the base wall 11*a* side and a drive chamber 15 on the lid 12 side, the partition 16 being a separate body from the casing main body 11. The partition plate 16 is secured to the carburetor C together with the base wall 11*a* by a plurality of bolts 17.

An opening 18 is provided in the base wall 11*a* of the casing main body 11. A depression 14*a* corresponding to the opening 18 is provided on the upper end face of the carburetor C. The depression 14*a* acts as part of the transmission chamber 14. Outer end parts of the choke valve shaft 7*a* and the throttle valve shaft 8*a* are arranged so as to face the depression 14*a*.

A first electric motor 20 and a second electric motor 21 are mounted on the partition plate 16 by screws 22 and 23 respectively in the drive chamber 15. Disposed in the transmission chamber 14 are a first transmission device 24 for transmitting an output torque of the first electric motor 20 to the choke valve shaft 7*a*, and a second transmission device 25 for transmitting a driving force of the second electric motor 21 to the throttle valve shaft 8*a*. In this way, the first and second electric motors 20 and 21 and the first and second transmission devices 24 and 25 are housed in the casing 10 and protected.

Figure 9A:
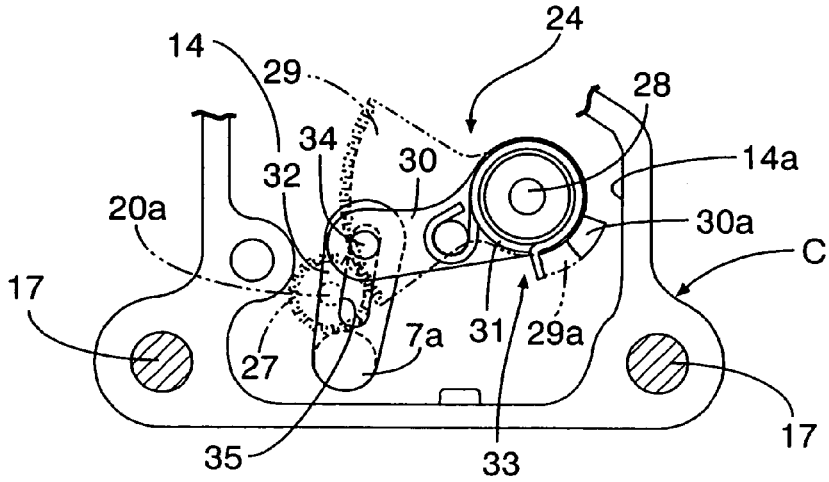
FIG. 9A and FIG. 9B are a plan view and a front view of a first transmission device controlling a choke valve in a fully closed state.
Figure 9B:
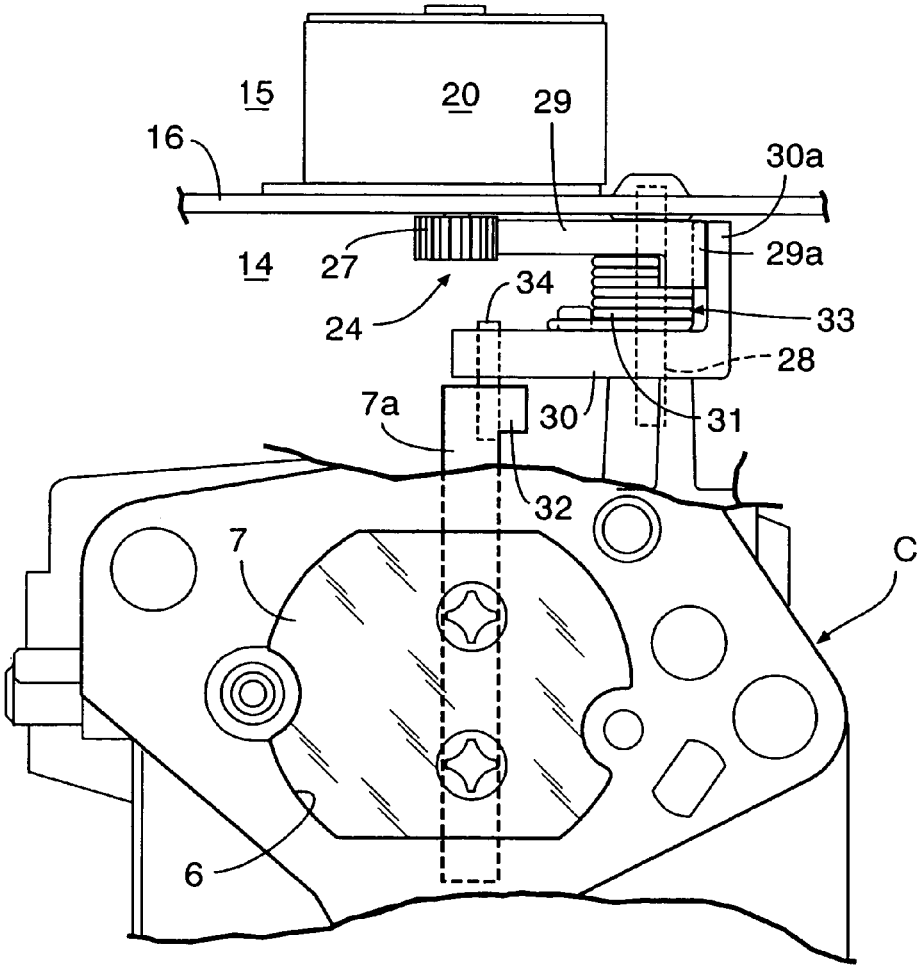

As shown in FIG. 7 to FIG. 9, the first transmission device 24 includes: a first pinion 27 secured to an output shaft 20*a* of the first electric motor 20; a first sector gear 29 that is rotatably supported on a first support shaft 28 having opposite end parts thereof supported on the partition plate 16 and the carburetor C and that meshes with the first pinion 27; a relief lever 30 supported on the first support shaft 28 while being relatively rotatably superimposed on the first sector gear 29; and a choke lever 32 formed integrally with the outer end part of the choke valve shaft 7*a* and joined to the relief lever 30. Formed on the first sector gear 29 and the relief lever 30 respectively are abutment pieces 29*a* and 30*a* that abut against each other and transmit to the relief lever 30 a driving force of the first sector gear 29 in a direction that opens the choke valve 7. A relief spring 31, which is a torsional coil spring, is mounted around the first support shaft 28. With a fixed set load, the relief spring 31 urges the first sector gear 29 and the relief lever 30 in a direction that makes the abutment pieces 29*a* and 30*a* abut against each other.

As clearly shown in FIG. 9, the structure linking the relief lever 30 and the choke lever 32 to each other is established by slidably engaging a connecting pin 34 projectingly provided on a side face at an extremity of the relief lever 30 with an oblong hole 35 that is provided in the choke lever 32 and that extends in the longitudinal direction of the lever 32.

The output torque of the first electric motor 20 is thus reduced and transmitted from the first pinion 27 to the first sector gear 29. Since the first sector gear 29 and the relief lever 30 are usually coupled via the abutment pieces 29*a*, 30*a* and the relief spring 31 to integrally pivot, the output torque of the first electric motor 20 transmitted to the first sector gear 29 can be transmitted from the relief lever 30 to the choke lever 32 and the choke valve shaft 7*a*, thus enabling the choke valve 7 to be opened and closed.

As shown in FIG. 8, the choke valve shaft 7*a* is positioned offset to one side from the center of the intake path 6, and the choke valve 7 is inclined relative to the central axis of the intake path 6 so that, in a fully closed state, a side of the choke valve 7 that has a larger rotational radius is on the downstream side of the intake path 6 relative to a side thereof that has a smaller rotational radius. Therefore, while the first electric motor 20 is operated so that the choke valve 7 is fully closed or held at a very small opening-degree, if the intake negative pressure of the engine E exceeds a predetermined value, the choke valve 7 can be opened regardless of the operation of the first electric motor 20, to a point at which the difference between the rotational moment due to the intake negative pressure imposed on the side of the choke valve 7 that has the larger rotational radius and the rotational moment due to the intake negative pressure imposed on the side of the choke valve 7 that has the smaller rotational radius, balances the rotational moment due to the relief spring 31 (see FIG. 11). The relief lever 30 and the relief spring 31 thus form a relief mechanism 33. The relief lever 30 and relief spring 31 are supported on the first support shaft 28, and are therefore positioned so as to be offset from the top of the output shaft 20*a* of the first electric motor 20 and the top of the choke valve shaft 7*a*.

Figure 10A:
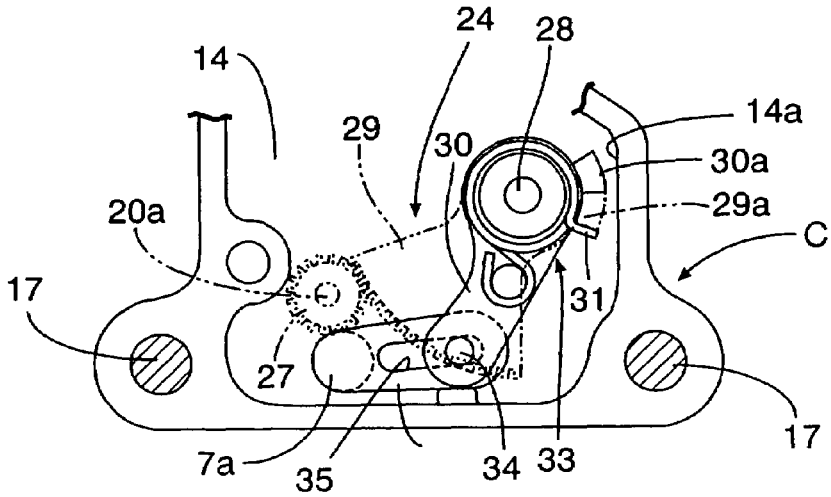
FIG. 10A and FIG. 10B are a plan view and a front view of the first transmission device controlling the choke valve in a fully opened state.
Figure 10B:
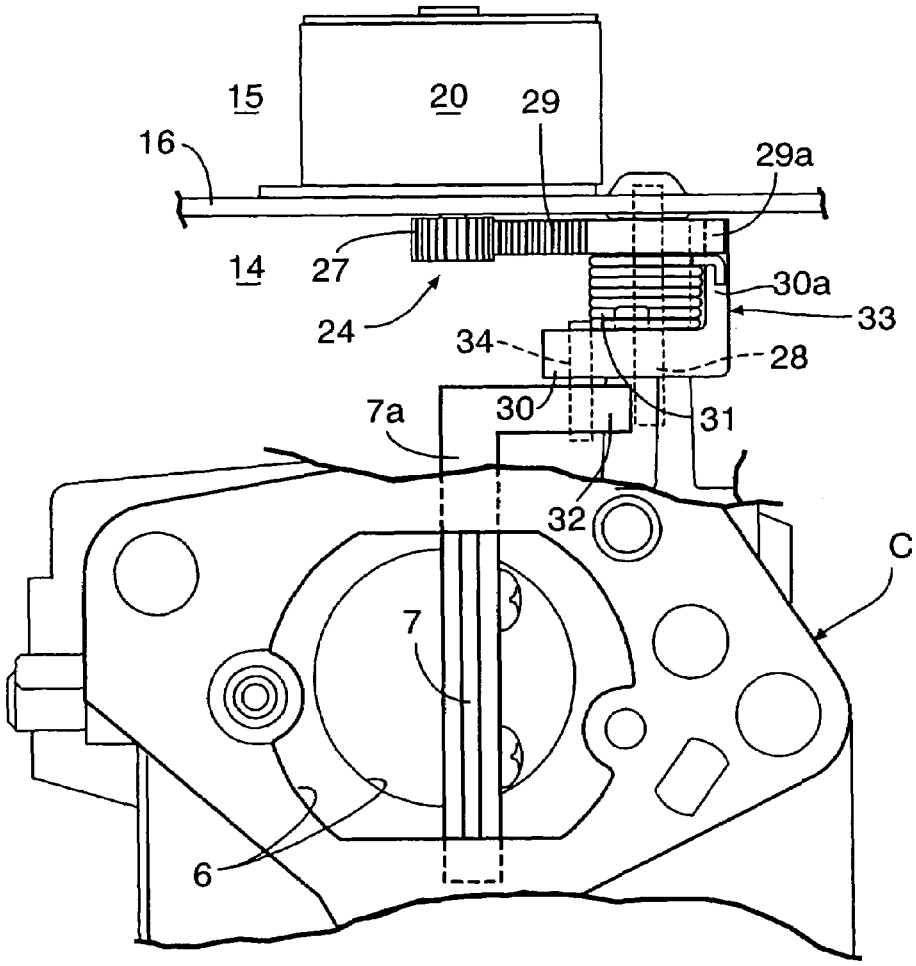
Figure 11A:
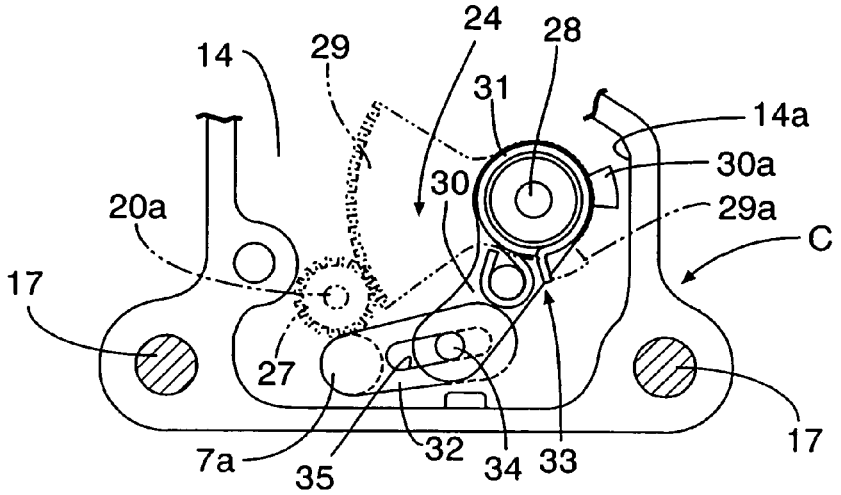
FIG. 11A and FIG. 11B are a plan view and a front view of the first transmission device showing an operating state of a relief mechanism.
Figure 11B:
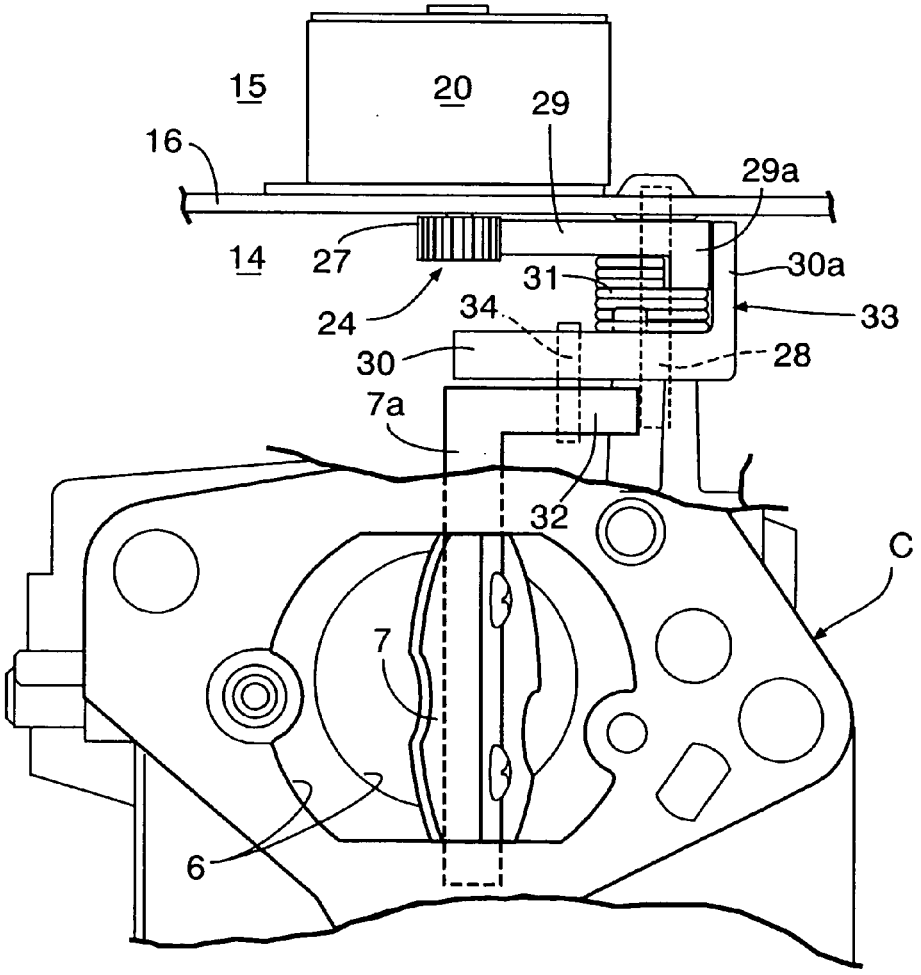
Figure 14:
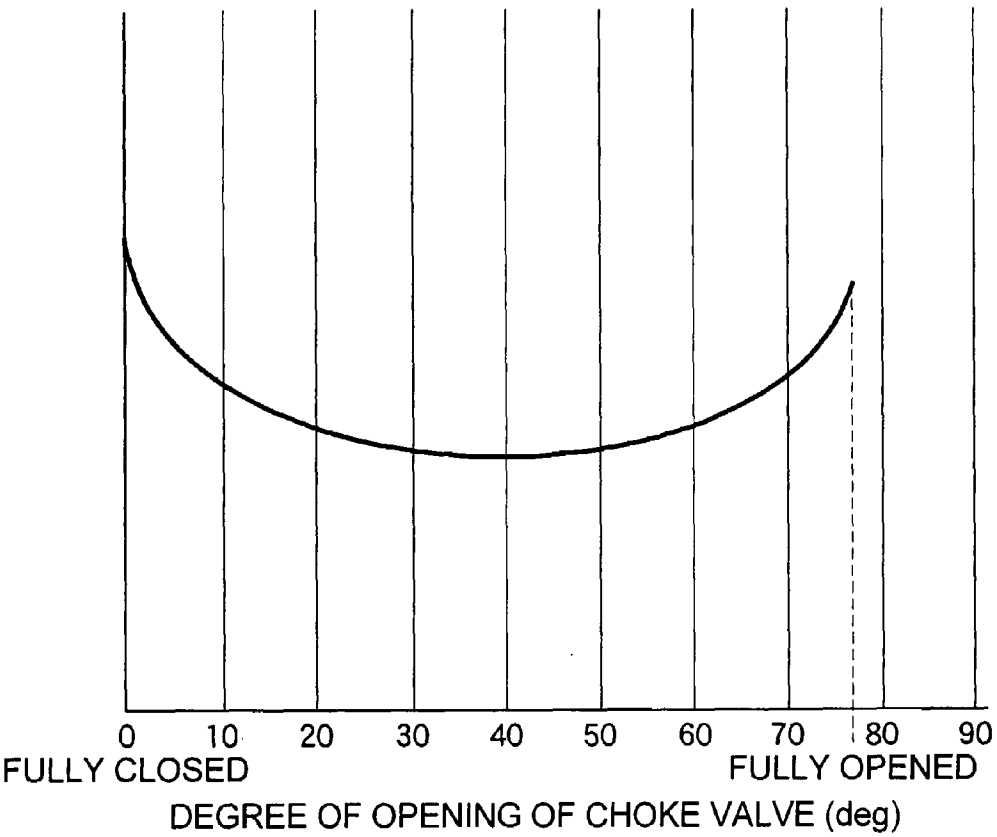
FIG. 14 is a graph showing the relationship between the degree of opening of the choke valve and the lever ratio between a relief lever and a choke lever.

As shown in FIG. 9 and FIG. 10, the relief lever 30 and the choke lever 32 are arranged at an exactly or approximately right angle when the choke valve 7 is in a fully opened position and in a fully closed position, and the connecting pin 34 is positioned at the end of the oblong hole 35 that is farther from the choke valve shaft 7*a*. When the choke valve 7 is at a predetermined medium opening-degree, the relief lever 30 and the choke lever 32 are arranged in a straight line, and the connecting pin 34 is positioned at the other end of the long hole 35 that is closer to the choke valve shaft 7*a*. Therefore, the effective arm length of the choke lever 32 becomes a maximum when the choke valve 7 is in fully opened and fully closed positions, and becomes a minimum when the choke valve 7 is at the predetermined medium opening-degree. As a result, the lever ratio between the relief lever 30 and the choke lever 32 changes, as shown in FIG. 14, such that it becomes a maximum when the choke valve 7 is in fully opened and fully closed positions and becomes a minimum when the choke valve 7 is at the predetermined medium opening-degree.

Even if the first electric motor 20 becomes inoperable when the choke valve 7 is in the fully opened state due to, for example, an insufficient amount of electricity stored in a battery 60 (FIG. 13) which will be described later, the engine E can be started because a choke valve forced closure mechanism 37 that forcibly closes the choke valve 7 is provided to adjoin one side of the relief lever 30.

As shown in FIG. 4, FIG. 7, and FIG. 12, the choke valve forced closure mechanism 37 includes: a lever shaft 38 having opposite end parts rotatably supported on the base wall 11*a* of the casing main body 11 and the carburetor C; an operating lever 39 coupled to the lever shaft 38 and disposed beneath the casing main body 11; an actuating arm 40 formed integrally with the lever shaft 38 and facing one side of the abutment piece 30*a* of the relief lever 30; and a return spring 41 which is a torsional coil spring and is connected to the actuating arm 40 so as to urge the actuating arm 40 in a direction that detaches it from the abutment piece 30*a*, that is, in a retraction direction. When the choke valve 7 is fully opened, by making the operating lever 39 pivot against the urging force of the return spring 41, the actuating arm 40 pushes the abutment piece 30*a* of the relief lever 30 in a direction that closes the choke valve 7.

The retraction position of the operating lever 39 and the actuating arm 40, which are connected integrally to each other, is restricted by one side of the actuating arm 40 abutting against a retaining pin 42 provided in the casing main body 11 so as to retain the fixed end of the return spring 41. The operating lever 39 is usually positioned so that it is not accidentally hit by any other objects, for example, in such a manner that the extremity of the operating lever 39 faces the engine E side. With this arrangement, erroneous operation of the operating lever 39 can be avoided.

The second transmission device 25 is now explained by reference to FIG. 4, FIG. 6, and FIG. 7.

The second transmission device 25 includes: a second pinion 44 secured to the output shaft 21*a* of the second electric motor 21; a second sector gear 46 that is rotatably supported on a second support shaft 45 having opposite end parts supported on the partition plate 16 and the carburetor C and that meshes with the second pinion 44; a non-constant speed drive gear 47 integrally molded with one side of the second sector gear 46 in the axial direction; and a non-constant speed driven gear 48 secured to an outer end part of the throttle valve shaft 8*a* and meshing with the non-constant speed drive gear 47. Connected to the non-constant speed driven gear 48 is a throttle valve closing spring 49 that urges the non-constant speed driven gear 48 in a direction that closes the throttle valve 8. By employing part of an elliptic gear or an eccentric gear, both the non-constant-speed drive and driven gears 47 and 48 are designed so that the gear ratio, that is, the reduction ratio between them decreases in response to an increase in the degree of opening of the throttle valve 8. Therefore, the reduction ratio is a maximum when the throttle valve 8 is in a fully closed state. With this arrangement, it becomes possible to minutely control the degree of opening in a low opening-degree region, which includes an idle opening-degree of the throttle valve 8, by operation of the second electric motor 21.

The first and second support shafts 28 and 45, which are components of the first and second transmission devices 24 and 25, are supported by opposite end parts thereof being fitted into the carburetor C and the partition plate 16, and serves as positioning pins for positioning the partition plate 16 at a fixed position relative to the carburetor C. Therefore, it is unnecessary to employ a positioning pin used exclusively for this purpose, thereby contributing to a reduction in the number of components. With this positioning of the partition plate 16, it is possible to appropriately couple the first transmission device 24 to the choke valve shaft 7*a*, and couple the second transmission device 25 to the throttle valve 8. Moreover, since the first and second electric motors 20 and 21 are mounted on the partition plate 16, it is possible to appropriately couple the first electric motor 20 to the first transmission device 24, and couple the second electric motor 21 to the second transmission device 25.

The electronic control unit 12*a* is now explained by reference to FIG. 4, FIG. 5, and FIG. 13.

As shown in FIG. 4 and FIG. 5, the electronic control unit 12*a* is formed by mounting various types of electronic components 51 to 54 on an electric circuit of a substantially rectangular printed wiring board 50, and connecting an input connector 55 and an output connector 56 to longitudinally opposite ends of the board 50. The board 50 is positioned parallel to the base wall 11*a* of the casing main body 11. Mounted on an inside face of the board 50 facing the drive chamber 15 are, for example, tall large electronic components such as a transformer 51, capacitors 52*a* to 52*c* and a heatsink 53, as well as thin low-profile electronic components such as a CPU 54. A pilot lamp 68 is mounted on an outside face of the board 50. The large electronic components 51 to 53 and the low-profile electronic component 54 are thus contained within the drive chamber 15, the large electronic components 51 to 53 being positioned in the vicinity of the partition plate 16 on one side of the drive chamber 15, and the low-profile electronic component 54 being positioned on the other side of the drive chamber 15. The first and second electric motors 20 and 21 are positioned in the vicinity of the board 50 and the low-profile electronic component 54 on said other side of the drive chamber 15. In this way, the first and second electric motors 20, 21 and the large electronic components 51 to 53 are arranged in a staggered manner.

With this staggered arrangement, the first and second electric motors 20, 21 and the large electronic components 51 to 53 can be efficiently housed in the drive chamber 15. Therefore, the dead space in the drive chamber 15 can be greatly reduced and the volume of the drive chamber 15 can be made smaller, thereby reducing the size of the casing 10 and consequently making compact the entire engine E including the carburetor C equipped with the electronic control system D.

In order to seal the board 50 mounting thereon the various types of electronic components 51 to 54, a flexible synthetic resin coating 57 for covering these components is formed by a hot-melt molding method or an injection molding method. Since this coating 57 is formed with a substantially uniform thickness along the shapes of the board 50 and the various types of electronic components 51 to 54, there are no unnecessary thick parts, and it does not interfere with the staggered arrangement of the first and second electric motors 20, 21 and the large electronic components 51 to 53, thus contributing to a reduction in the size of the casing 10. Furthermore, since this coating 57 exhibits the function of tightly sealing opposing faces of the casing main body 11 and the cover 12*b*, it is unnecessary to employ a seal member used exclusively for this purpose, thereby contributing to a reduction in the number of components and an improvement of the ease of assembly.

A light-emitting part of the pilot lamp 68 (FIG. 5) is positioned so as to run through the coating 57 and the cover 12*b*, and its lit and unlit states accompanying a main switch 64 being turned on or off can be visually identified from outside the lid 12.

Figure 13:
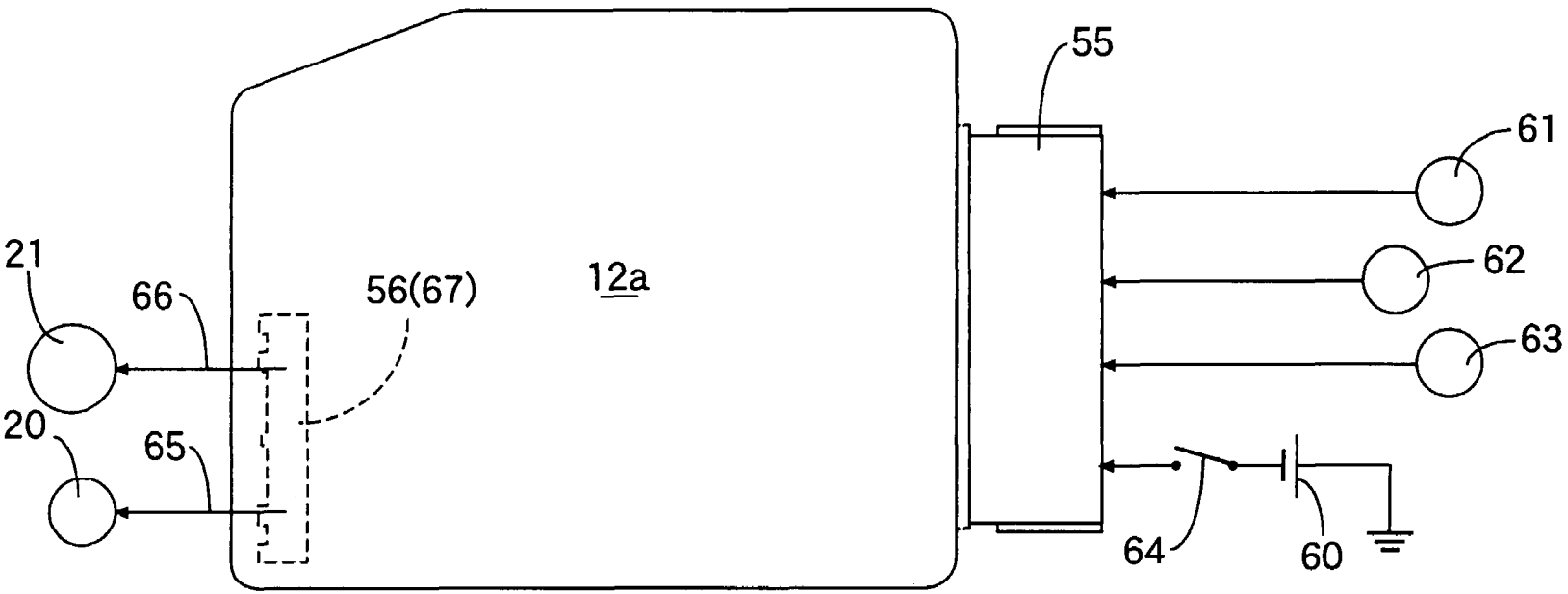
FIG. 13 is a plan view of an electronic control unit.

In FIG. 13, electric power of the battery 60, an output signal of a rotational speed setting device 61 that sets a desired rotational speed for the engine E, an output signal of a rotational speed sensor 62 for detecting the rotational speed of the engine E, an output signal of a temperature sensor 63 for detecting a temperature of the engine E, etc., are input via the input connector 55 into the electronic control unit 12*a*. The main switch 64 is provided on an energizing circuit between the battery 60 and the input connector 55.

Connected to the output connector 56 is an internal connector 67 (see FIG. 6), which is connected to wire harnesses 65 and 66 for energization of the first and second electric motors 20 and 21.

The operation of this embodiment is now explained.

In the electronic control unit 12*a*, when the main switch 64 is switched on, the first electric motor 20 is operated by the power of the battery 60 based on the output signal of the temperature sensor 63, and the choke valve 7 is operated via the first transmission device 24 to a start opening-degree according to the engine temperature at that time. For example, when the engine E is cold, the choke valve 7 is driven to a fully closed position as shown in FIG. 9; and when the engine E is hot, the choke valve 7 is maintained at a fully opened position as shown in FIG. 10. Since the start opening-degree of the choke valve 7 is controlled in this way, by subsequently operating the recoil starter 5 for cranking in order to start the engine E, an air-fuel mixture having a concentration suitable for starting the engine at that time is formed in the intake path 6 of the carburetor C, thus always starting the engine E easily.

Immediately after starting the engine in a cold state, an excessive intake negative pressure of the engine E acts on the choke valve 7 which is in a fully closed state. As a result, as described above, since the choke valve 7 is automatically opened (see FIG. 11), regardless of operation of the first electric motor 20, until the difference between the rotational moment due to the intake negative pressure acting on the side of the choke valve 7 having a large rotational radius and the rotational moment due to the intake negative pressure acting on the side of the choke valve 7 having a small rotational radius balances the rotational moment due to the relief spring 31, the excessive intake negative pressure can be eliminated, thus preventing the air-fuel mixture from becoming too rich to ensure good warming-up conditions for the engine E.

Since the relief mechanism 33, which includes the relief lever 30 and the relief spring 31, is positioned so as to be offset from the top of the output shaft 20*a* of the first electric motor 20 and the top of the choke valve shaft 7*a*, the relief mechanism 33 is not superimposed on the output shaft 20*a* of the first electric motor 20 or the choke valve shaft 7*a*, and the transmission chamber 14 housing the first transmission device 24 can be made flat while providing the relief mechanism 33 in the first transmission device 24, thereby contributing to a reduction in the size of the casing 10.

When the engine temperature increases accompanying the progress of warming-up, the first electric motor 20 is operated based on the output signal of the temperature sensor 63 which changes according to the engine temperature, so that the choke valve 7 is gradually opened via the first transmission device 24. When the warming-up is completed, the choke valve 7 is put in a fully opened state (see FIG. 10), and this state is maintained during subsequent running.

On the other hand, the second electric motor 21 operates based on the output signals of the rotational speed setting device 61 and the rotational speed sensor 62, and controls opening and closing of the throttle valve 8 via the second transmission device 25 so that the engine rotational speed coincides with a desired rotational speed set by the rotational speed setting device 61, thus regulating the amount of air-fuel mixture supplied from the carburetor C to the engine E. That is, when an engine rotational speed detected by the rotational speed sensor 62 is lower than the desired rotational speed set by the rotational speed setting device 61, the degree of opening of the throttle valve 8 is increased, and when it is higher than the desired rotational speed, the degree of opening of the throttle valve 8 is decreased, thus automatically controlling the engine rotational speed to be the desired rotational speed regardless of a change in the load. It is therefore possible to drive various types of work machines by the motive power of the engine E at a stable speed regardless of a change in the load.

Running of the engine E can be stopped by switching the main switch 64 off and operating a kill switch (not illustrated) of the engine E. After completing a given operation, the engine E is usually in a hot state, and thus the choke valve 7 is maintained in a fully opened state by the first electric motor 20. Therefore, after running of the engine E is stopped, the fully opened state of the choke valve 7 is maintained. When the engine E is left in a cold region, an icing phenomenon often occurs, that is, water droplets condensed around the choke valve shaft 7*a* are frozen and the choke valve 7 becomes stuck. Such a phenomenon generally makes it difficult for the choke valve 7 to move to the fully closed state when the engine is started anew.

However, in the first transmission device 24, as described above, the structure coupling the relief lever 30 and the choke lever 32 to each other is arranged so that the lever ratio of the two levers 30 and 32 is a maximum when the choke valve 7 is in fully opened and fully closed positions, and a minimum when the choke valve 7 is at the predetermined medium opening-degree. Therefore, when the engine E is cold-started and the first electric motor 20 operates in a direction that closes the choke valve 7 based on the output signal of the temperature sensor 63, a maximum torque can be applied to the choke valve shaft 7*a*, thus crushing ice around the choke valve shaft 7*a* to reliably drive the choke valve 7 from the fully opened position to the fully closed position, whereby the reliability of an autochoke function is guaranteed without any problem in the cold starting.

Moreover, with the structure coupling the relief lever 30 and the choke lever 32 to each other, the torque acting on the choke valve shaft 7*a* from the first electric motor 20 can be made a maximum at least when the choke valve 7 is in the fully opened position. Therefore, an increase in the number of stages of reduction gears such as the first pinion 27 and the first sector gear 29 of the first transmission device 24 can be suppressed, thereby contributing to a reduction in the size of the first transmission device 24, and consequently reducing the volume of the transmission chamber 14 and the size of the casing 10. Furthermore, an unreasonable reduction ratio need not be given to the first pinion 27 and the first sector gear 29, and there are no concerns about degradation in the tooth base strength of the gears due to an excessive reduction in the module thereof.

Figure 12A:
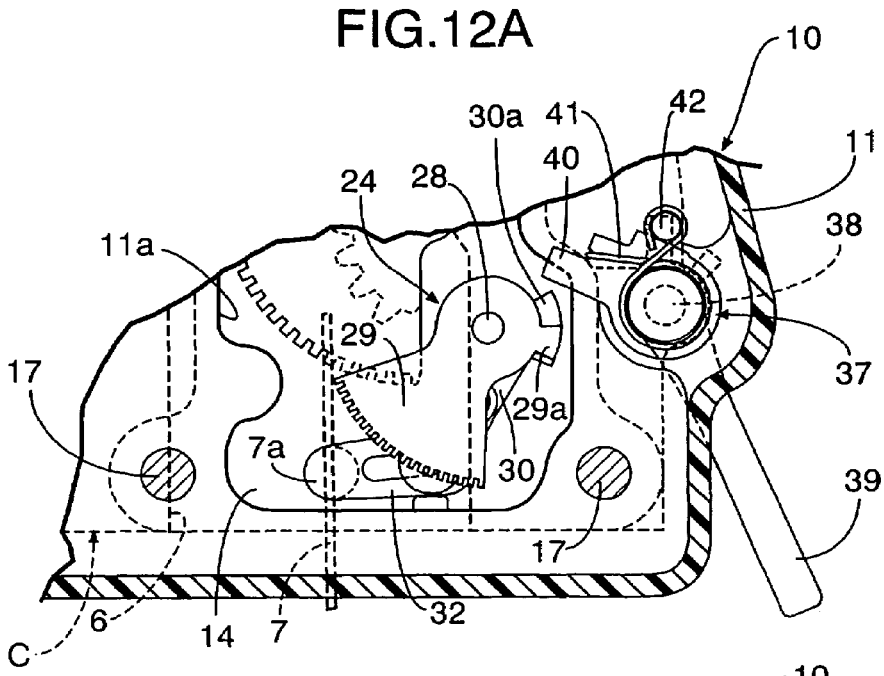
FIG. 12A and FIG. 12B are plan views showing a non-operating state and an operating state of a choke valve forced closure mechanism in FIG. 7.
Figure 12B:
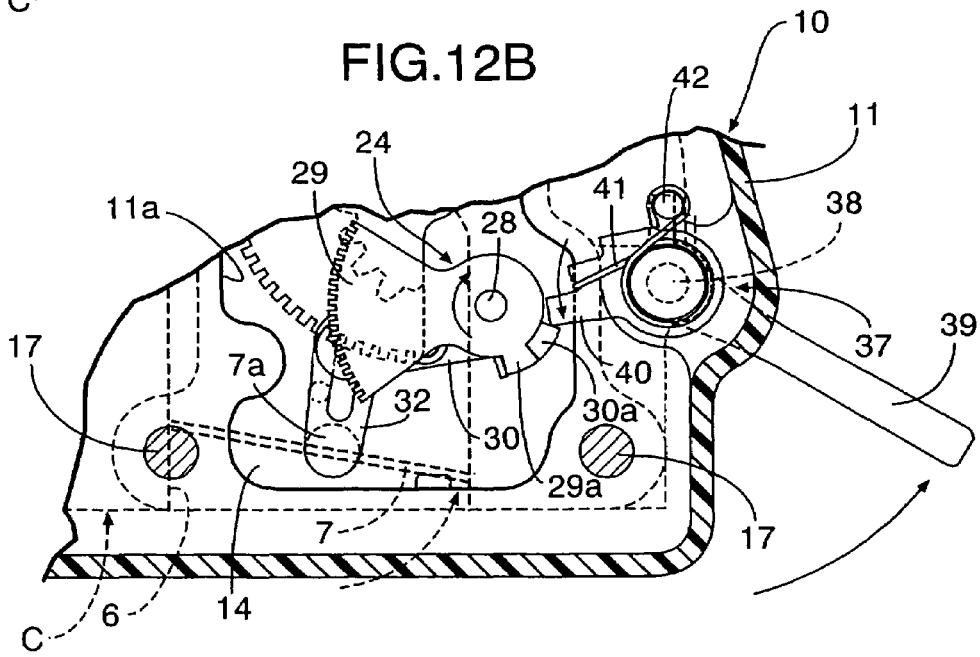

During cold starting, if the amount of electricity stored in the battery 60 is insufficient, the first electric motor 20 does not operate, the choke valve 7 remains open as shown in FIG. 12A, and when starting, a rich air-fuel mixture suitable for cold starting cannot be generated in the intake path 6. In such a case, as shown in FIG. 12B, the operating lever 39 of the choke valve forced closure mechanism 37 is held and pivoted against the urging force of the return spring 41. As a result, the actuating arm 40, which is coupled to the operating lever 39 and faces the abutment piece 30*a* of the relief lever 30, pushes the abutment piece 30*a*, and this pushing force is transmitted from the relief lever 30 to the choke lever 32 so as to close the choke valve 7 to the fully closed position; if the engine E is started in this operating state, a rich air-fuel mixture suitable for cold starting can be generated in the intake path 6, thus reliably carrying out cold starting.

When the engine E starts, since the function of the battery 60 is recovered due to the operation of a generator generally provided in the engine E, or the generator directly supplies electricity to the electronic control unit 12*a*, the first electric motor 20 operates normally, the choke valve 7 is controlled to an appropriate warm-up opening-degree, and it is therefore necessary to return the actuating arm 40 to a non-operating position retracted from the relief lever 30 so as not to interfere with the operation of the first electric motor 20.

Then, if the hand is released from the operating lever 39, the operating lever 39 and the actuating arm 40 is automatically returned to the non-operating position by virtue of the urging force of the return spring 41, thereby preventing any increase in the load on the first electric motor 20 caused by the operating lever 39 being erroneously left unreturned.

The actuating arm 40 can push the abutment piece 30*a* of the relief lever 30 only in a direction that closes the choke valve 7, and when it is held at the retracted position by a set load of the return spring 41, it merely faces the abutment piece 30*a* of the relief lever 30 and is put in a state in which it is detached from the first transmission device 24. Therefore, when the choke valve 7 is driven normally by the first electric motor 20, the choke valve forced closure mechanism 37 does not impose any load on the first transmission device 24, thereby preventing malfunction of or damage to the first transmission device 24.

Although an embodiment of the present invention has been described in detail above, the present invention is not limited to the above-mentioned embodiment and can be modified in a variety of ways without departing from the subject matter of the present invention.

What is claimed is:

1. A carburetor electronic control system comprising:

a transmission device coupled to a valve for opening and closing an intake path of a carburetor;

an electric actuator that makes the valve open and close via the transmission device; and an electronic control unit for controlling the operation of the electric actuator, wherein the interior of a casing joined to one side face of the carburetor is divided by a partition plate into a transmission chamber on the carburetor side and a drive chamber on the side opposite thereto; and the transmission device and the electric actuator are housed and held in the transmission chamber and the drive chamber, respectively.

2. The carburetor electronic control system according to claim 1, wherein the valve is a choke valve; the transmission device coupled thereto comprises a pinion fixedly provided on an output shaft of the electric actuator, a large diameter gear meshing with the pinion, a first lever that pivots together with the large diameter gear, and a second lever that is fixedly provided on a valve shaft of the choke valve and is pivoted by the first lever; and a structure with which the first and second levers are coupled is arranged so that a lever ratio between the first lever and the second lever increases in shifting from a medium-opening degree position of the choke valve to a fully opened position.

3. The carburetor electronic control system according to claim 2, wherein the structure with which the first and second levers are coupled comprises a connecting pin that is projectingly provided on a side face at an extremity of one of the first and second levers, and an oblong hole that is provided in the other one of the first and second levers and extends in the longitudinal direction thereof, the connecting pin slidably engaging with the oblong hole; and the lever ratio between the first lever and the second lever increases in shifting from the medium-opening degree position of the choke valve to the fully opened position by changing an effective arm length of the first lever or the second lever according to a change in the opening degree of the choke valve.

4. The carburetor electronic control system according to claim 1, wherein the valve is a choke valve; the transmission device coupled thereto and the electric actuator are housed within the casing mounted on one side face of the carburetor; and the transmission device is provided with a relief mechanism which allows the choke valve to be opened by intake negative pressure that is equal to or higher than a predetermined value and that is generated in the intake path, the relief mechanism being disposed between and offset from the top of an output shaft of the electric actuator and the top of a valve shaft of the choke valve.

5. The carburetor electronic control system according to claim 1, wherein the casing comprises a casing main body that is joined to one side face of the carburetor, and a lid that blocks an open face of the casing main body; the transmission device and the electric actuator are held within the casing main body; and at least one part of the lid is formed from the electronic control unit.

6. The carburetor electronic control system according to claim 5, wherein the electronic control unit comprises a board that has wiring of an electronic control circuit printed thereon and is disposed so as to close the open face of the casing main body, and various types of electronic components that are mounted on a side of the board that faces the interior of the casing main body; and among the various types of electronic components, tall large electronic components and the electric actuator are disposed on one side and the other side respectively within the casing main body.

7. The carburetor electronic control system according to claim 5 or 6, wherein the lid comprises the electronic control unit and a cover that is fixed to the casing main body so as to hold the electronic control unit between the cover and the casing main body.

8. The carburetor electronic control system according to claim 6, wherein a soft synthetic resin coating is formed on surfaces of the board and the various types of electronic components so as to cover the surfaces, the coating being in intimate contact with the open end face of the casing main body.

9. The carburetor electronic control system according to claim 5, wherein a soft synthetic resin coating is formed on a surface of the electronic control unit so as to cover the surface, the coating being in intimate contact with the open end face of the casing main body.

* * * * *